US006523871B1

(12) United States Patent
Josserand

(10) Patent No.: US 6,523,871 B1
(45) **Date of Patent: *Feb. 25, 2003**

(54) MOTOR VEHICLE OPENING-LEAF HANDLE INCLUDING IMPROVED MEANS FOR IMMOBILIZING AN EXTERNAL ELEMENT

(75) Inventor: Luc Josserand, Turin (IT)

(73) Assignee: Valeo Securite Habitacle, Cedex (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/498,954

(22) Filed: Feb. 4, 2000

(30) Foreign Application Priority Data

Feb. 5, 1999 (FR) ..... 99 01397

(51) Int. Cl.[7] ..... E05B 1/00

(52) U.S. Cl. ..... 292/347; 292/350; 292/352; 292/DIG. 41

(58) Field of Search ..... 292/336.3, 347, 292/348, 350, 352, DIG. 31, DIG. 41, DIG. 53, DIG. 67

(56) References Cited

U.S. PATENT DOCUMENTS 2,102,714 A * 12/1937 Jakeway ..... 292/350
2,322,275 A * 6/1943 Birdsall et al. ..... 292/348
2,761,721 A * 9/1956 Jakeway ..... 292/336.3
4,883,296 A * 11/1989 Laurie ..... 292/336.3
6,234,548 B1 * 5/2001 Mittelbach et al. ..... 292/336.3
6,239,693 B1 * 5/2001 Benard et al. ..... 340/426

FOREIGN PATENT DOCUMENTS

| | | |
|---|---|---|
| DE | 30 30 519 | 2/1982 |
| EP | 0 276 972 | 8/1988 |
| EP | 0 681 075 | 11/1995 |
| EP | 0 728 885 | 8/1996 |

* cited by examiner

*Primary Examiner*—Jack Lavinder
*Assistant Examiner*—Thomas J. Williams
(74) *Attorney, Agent, or Firm*—Morgan & Finnegan, LLP

(57) ABSTRACT

The invention proposes a motor vehicle opening-leaf handle including a handle including a handle support which is arranged in an interior space of the opening leaf, of the type in which an external element of the handle is equipped with an attachment tang which is engaged transversely inward through an orifice formed in the outer panel, to be secured to the handle support, which handle includes a member for immobilizing the attachment tang, the immobilizing member being mounted so that it can move on the handle support and being maneuvered between an unlocked position and an immobilizing position by a maneuvering mechanism which can be manipulated through an opening made in the edge panel of the opening leaf.

18 Claims, 5 Drawing Sheets

MOTOR VEHICLE OPENING-LEAF HANDLE INCLUDING IMPROVED MEANS FOR IMMOBILIZING AN EXTERNAL ELEMENT

BACKGROUND OF THE INVENTION

The invention relates to a motor vehicle opening-leaf handle including improved means for immobilizing an external element.

BRIEF SUMMARY OF THE INVENTION

The invention relates more particularly to a motor vehicle opening-leaf handle, of the type in which the opening leaf has an internal space delimited by two panels, inner and outer, which are connected by an edge panel, of the type in which the handle includes a handle support which is arranged in the interior space of the opening leaf, and of the type in which an external element of the handle is equipped with an attachment tang which is engaged transversely inward through an orifice formed in the outer panel, to be secured to the handle support and thus attach the external element.

A motor vehicle handle may include various types of element arranged on the outside of the bodywork panel. In the case of a particularly simple handle, this may be a simple fixed bar for grasping, by means of which the user can move the opening leaf between an open position and a closed position.

It may also be a body intended to take a lock for locking a lock of the opening leaf, this body including an external part which, on the one hand, allows access to the lock, so that a key can be inserted, and which, on the other hand, esthetically integrates the lock.

Furthermore, the external element may also be an element which plays a part in attaching the handle to the opening leaf.

The attachment of such an element raises numerous problems.

For esthetic reasons, it is desirable that the means of attaching this external element should not be visible from outside the vehicle. Now, the support for attaching the handle is generally arranged in a place in the opening leaf which is not readily accessible, particularly once the opening leaf has been completely assembled and the interior door linings have been fitted. Specifically, the attachment support is generally arranged inside a closed box section of the opening leaf delimited, in particular, by the inner and outer panels.

When the desire is for the external element not to be fitted until the last moment of assembling the opening leaf or when the desire is for this element to be removable, for example to carry out repairs to the outer bodywork panel, it is then advantageous to be able to have easy access to the means of attachment of the external element.

To this end, the invention proposes a motor vehicle opening-leaf handle, of the type in which the opening leaf has an internal space delimited by two panels, inner and outer, which are connected by an edge panel, of the type in which the handle includes a handle support which is arranged in the interior space of the opening leaf, and of the type in which an external element of the handle is equipped with an attachment tang which is engaged transversely inward through an orifice formed in the outer panel, to be secured to the handle support and thus attach the external element, which handle includes a member for immobilizing the attachment tang, the immobilizing member being mounted so that it can move on the handle support and being maneuvered between an unlocked position and an immobilizing position by a maneuvering mechanism which can be manipulated through an opening made in the edge panel of the opening leaf.

According to other features of the invention:

- the immobilizing member is mounted so that it can slide in the support in a direction perpendicular to the transverse direction of engagement of the external element, and the immobilizing member includes at least one lug which, in the immobilizing position, is housed in a complementary housing in the tang of the external element to prevent the possibility of the external element being extracted transversely outward;
- the lug and the housing collaborate via two complementary surfaces which are inclined with respect to the transverse direction of engagement of the external element and with respect to the direction of sliding of the immobilizing member so that, when the immobilizing member is brought into its immobilizing position, the external element is urged transversely inward by the lug of the immobilizing member;
- the tang of the external element is guided in sliding in the transverse direction in the handle support;
- the immobilizing member has the shape of a U-shaped yoke with two parallel longitudinal branches connected at their rear end by a base which runs at right angles to the two branches and at right angles to the transverse direction, the yoke is introduced longitudinally from front to rear as far as a forward unlocked position, into a complementary slideway arranged at the rear of the support, and the yoke is brought by the maneuvering means longitudinally rearward as far as its immobilizing position in which the lugs formed at the front ends of each branch are engaged in corresponding housings in the tang of the external element, the latter then being housed between the two longitudinal branches of the immobilizing yoke;
- the handle support includes means for prepositioning the immobilizing member which, while the handle is being fitted, hold it in its unlocked position;
- the maneuvering means consist of a threaded rod of longitudinal axis which is screwed into the base of the yoke, the front end of which bears against a surface which is longitudinally fixed, and the rear end of which exhibits a socket which complements that of a manipulating tool which can be introduced through the opening in the edge panel of the opening leaf;
- the threaded rod rests against a lateral surface of the tang of the external element;
- the external element forms a locking body which plays a part in attaching the handle to the opening leaf;
- the external element forms a fixed element for grasping by means of which a user may bring the opening leaf from a closed position into an open position; and
- the external element forms a case intended to house a latch.

BRIEF DESCRIPTION OF THE DRAWINGS

Other features and advantages of the invention will become apparent from reading the detailed description which follows, for an understanding: of which reference will be made to the appended drawings, in which.

DETAILED DESCRIPTION OF THE INVENTION

Figure 1:
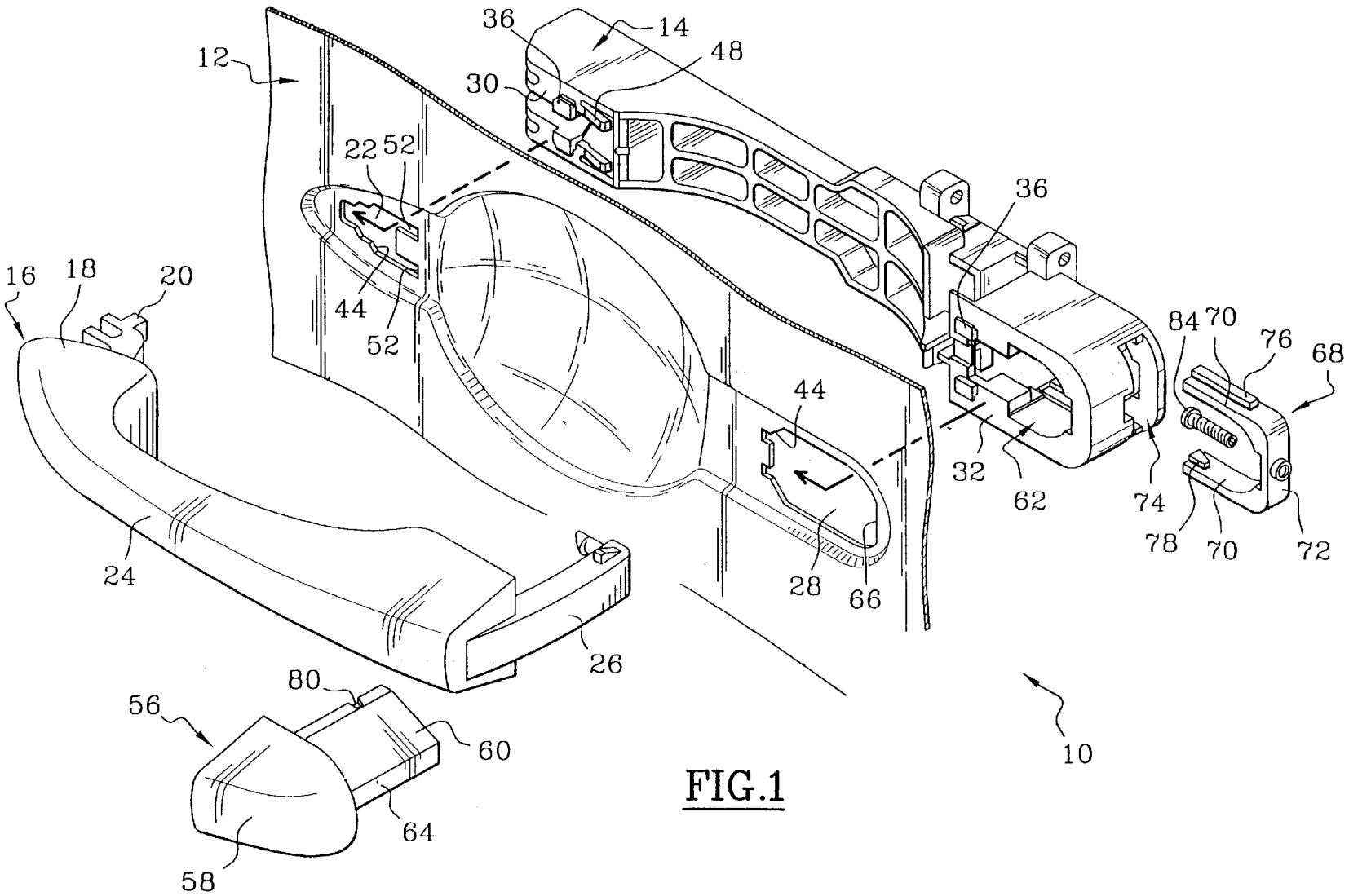
FIG. 1 is a diagrammatic exploded view in perspective of an opening-leaf handle according to the invention including a support arranged on the inside of a bodywork panel and a member for grasping arranged on the outside of the panel.

FIG. 1 illustrates a handle 10 intended to be mounted on an outer bodywork panel 12 of a motor vehicle opening leaf. The handle 10 essentially includes a handle support 14, which is intended to be fixed on the inside of the panel 12, and a lever 16 for grasping which is intended to be arranged on the outside of the panel 12, while at the same time being fixed to the support 14.

In the embodiment illustrated in the figures, the grasping lever 16 is in the form of a bar which runs in a horizontal longitudinal direction with respect to a conventional orientation of the motor vehicle, and is articulated to the support 14 by its front end 18, about a vertical axis A1, that is to say an axis which is roughly parallel to the plane of the bodywork panel 12 and perpendicular to the longitudinal direction of the lever 16.

Of course, the ideas of the horizontal and vertical are used in this instance with a view to simplifying the understanding of the description and must not be taken to be a limitation on the scope of the invention, particularly as regards the orientation of the handle.

To articulate it to the support 14, the front end 18 of the lever 16 has a hinge element 20 which extends transversely inward through a front opening 22 formed in the panel 12 and which collaborates with a hinge element of the support 14. At its rear end 24, the grasping lever 16 has an operating element 26 which is intended to run transversely inward through a rear opening 28 made in the panel 12, so as to be able to operate a linkage associated with a lock so as to cause the opening leaf to open when the user manipulates the grasping lever 16 by moving it away from the plane of the panel 12.

Of course, the angular travel of the grasping lever 16 about the axis A1 is limited by means which have not been depicted.

In the illustrated embodiment of the invention, the handle support 14 is intended to be fitted on the bodywork panel using a bayonet fitting method and the handle includes a locking body which is intended to be engaged transversely from the outside inward through the outer bodywork panel so that an attachment tang of the locking body can be fixed to the locking support.

According to the teachings of the invention, quick and reliable means of attaching the locking body will be described, it being possible for these means to be implemented easily even once the opening leaf has been fully assembled.

It may be seen in FIG. 1 that the support 14 includes a front bearing surface 30 and a rear bearing surface 32 each of which is intended to bear transversely outward against the internal face of the bodywork panel. At each of these two bearing surfaces, the support 14 has attachment tabs 36 which extend transversely outward.

In the example illustrated, the support 14 includes two attachment tabs 36 at its front bearing surface 30 and two more tabs 36 at its rear bearing surface 32.

To mount the support 14, the latter is first of all brought, in a first approach movement, transversely from the inside outward, to bear against the internal face of the panel 12 so that the tabs 36 engage through corresponding openings 22 and 28.

Next, when the support 14 has reached an intermediate fitting position in which these two bearing faces 30, 32 are bearing against the internal face, the support 14 is then moved longitudinally forward simply by sliding along the bodywork panel 12. During this catching movement, the ends of each of the tabs 36 are intended to engage behind an external face 42 of the bodywork panel 12.

Specifically, the front opening 22 and rear opening 28 include bearing edges 44 which lie in the path of the tabs 36 when the support 14 is moved longitudinally forward from an intermediate fitting position.

Thus, when the support 14 has reached its furthest-forward longitudinal position, which corresponds to its final position, the tabs 36 prevent the possibility of it being withdrawn transversely inward with respect to the bodywork panel 12.

Furthermore, there are means which allow the support 14 to be automatically immobilized, at least temporarily, when it reaches its final position, so as to prevent it from retreating longitudinally backward with the risk of the catching tabs 36 disengaging.

To do this, it can be seen that the support 14 includes, at the rear of its front bearing surface 30, and more specifically to the rear of each of the tabs 36 borne by the latter, two elastic arms 48 which run approximately longitudinally, which are connected to the support 14 by their front end, and the rear end of which runs transversely outward with respect to the plane of the bearing surface 30 when they are in the unconstrained state as illustrated in FIG. 1.

The elastic arms 48, which are formed integrally with the support, can be urged transversely inward so that they no longer transversely run outward beyond the plane of this surface. This is what happens when the support 14 is brought to bear against the internal face of the panel 12.

However, when the support 14 reaches its final position, the elastic arms 48 face the front opening 22 so that they can revert to their unconstrained position. Their rear end then finds itself longitudinally just in front of a rear edge 52 of the opening 22 again. Thus, extending transversely outward by a distance approximately equal to the thickness of the bodywork panel, the rear ends of each of the arms 48 then find themselves bearing again, in the longitudinal direction, in the plane of the bodywork panel 12, against the rear edge 52 of the front opening 22 which forms a locking cutout, thus preventing the support 14 from moving back.

As will be described with reference to FIGS. 2 to 8, the handle according to the invention includes additional locking means, the action of which combines with that of the elastic arms 48 which, in this case, are used essentially to prelock the handle support 14.

To this end, the handle includes a locking body 56 exhibiting an outer part 58 and an attachment tang 60 which extends transversely inward to be housed through the rear opening 28 in the outer bodywork panel 12 of the opening leaf and to be guided in terms of sliding in the transverse direction in a complementary cavity 62 formed in the handle support 14.

The outer part 58 has a bearing face 63 facing toward the external face 42 of the panel 12.

When the support 14 is in the final fitted position, the tang 60 of the locking body 56 is engaged transversely inward in the cavity 62 in the support 14 from the outside of the opening leaf so that the locking body 56 is thus immobilized with respect to the support 14 in all directions except the transverse direction. Now, at the same time, it can been seen in FIG. 8 that a rear lateral face 64 is then bearing longitudinally backward against a rear edge 66 of the rear opening 28. Also, the locking body 56 prevents any backward longitudinal withdrawal of the support 14 from the outer panel 12, and this eliminates any risk of the support 14 being removed should the elastic arms 48 break.

According to the teachings of the invention, to secure the locking body in the cavity 62 of the support 14, the handle 10 includes a yoke 68 which is mounted to slide longitudinally in the rear part of the support 14. The yoke 68 essentially includes two longitudinal branches 70 connected at their rear end by a base 72 so that, in a plane perpendicular to the transverse direction, the yoke 68 is approximately in the shape of a U which is open forward.

At their front end, the branches 70 are each equipped with a lug 78, each lug 78 running approximately toward the opposite branch. As will be seen later, the lugs 78 are intended to be housed in complementary housings 80 formed in the tang 60.

The yoke 68 is intended to be engaged in a slideway 74 in the support 14 which opens longitudinally at the rear. The accurate guidance of the yoke 68 is provided, in particular, by rails 76 formed on the external faces of the branches 70 of the locking body 56.

Before the support 14 is fitted on the opening leaf, the yoke 68 is engaged longitudinally from the rear forward in the slideway 74 as far as a forward unlocked position in which the branches 72 run one on each side of the cavity 62, the lugs 78 being arranged at the front of the cavity so that the yoke 68 cannot prevent the tang 60 of the locking body 56 from being introduced into the cavity 62.

Figure 2:
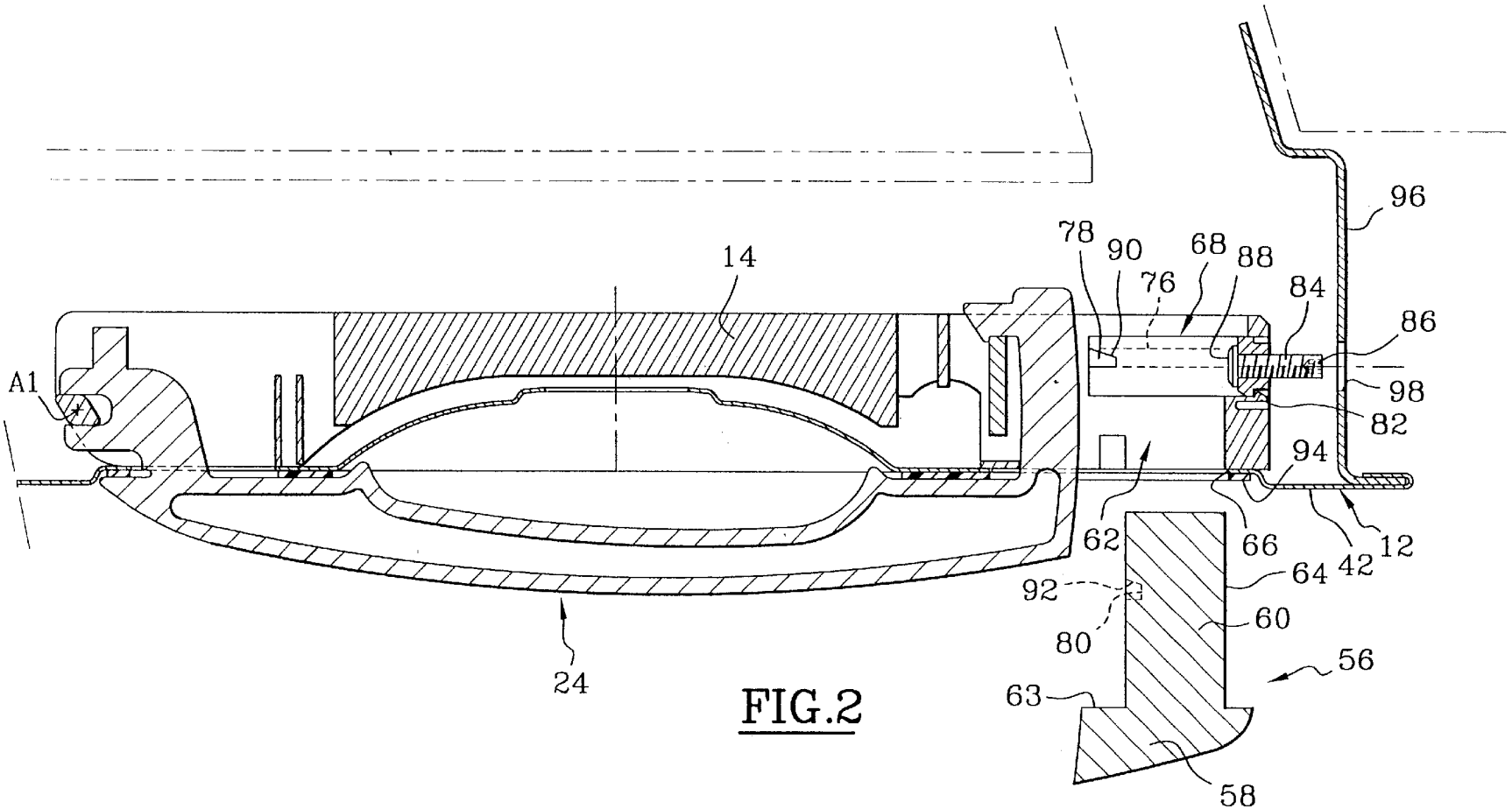
FIGS. 2 to 4 are diagrammatic views in section on a longitudinal and transverse plane of the handle which illustrate more specifically the fitting and immobilizing of an additional locking body of the handle.
Figure 3:
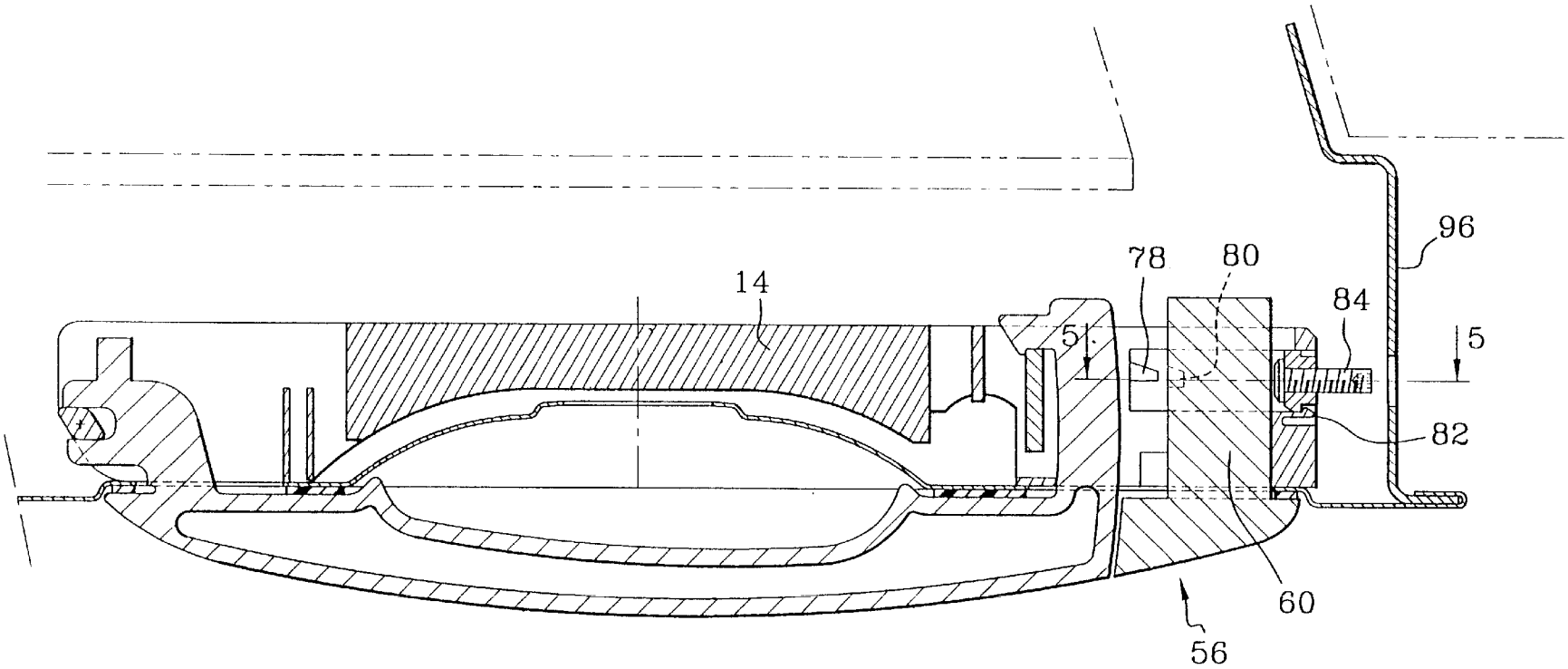

It will be noted in FIGS. 2 and 3 that the support 14 includes an elastic leaf 82 which retains the yoke 68 longitudinally in its forward unlocked position to prevent it from being able to escape from the slideway 74 simply under the effect of its own weight.

Figure 5:
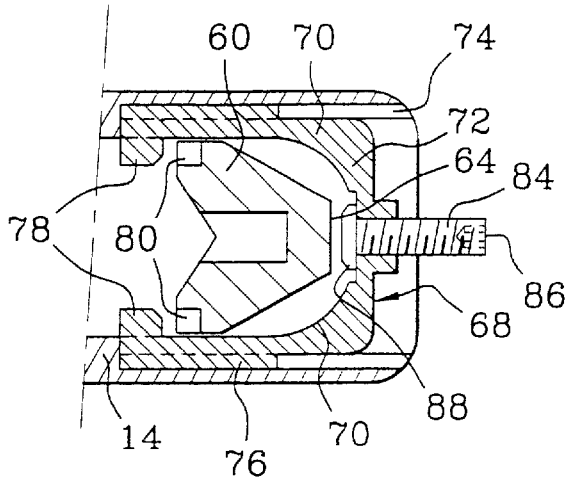
FIGS. 5 and 6 are views in section on the lines 5—5 and 6—6 respectively of FIGS. 3 and 4, illustrating the immobilizing of the locking body.
Figure 6:
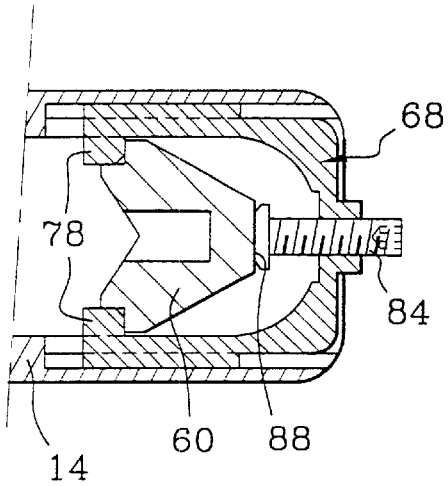
Figure 7:
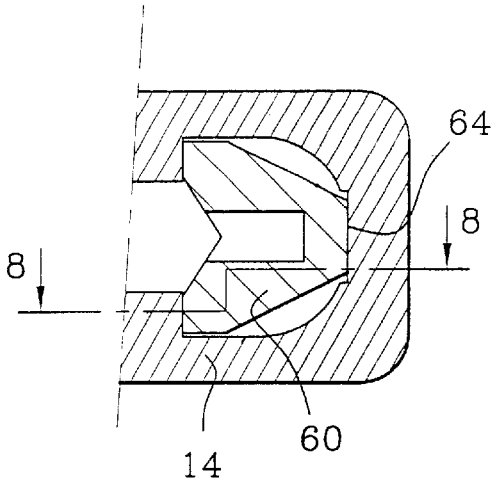
FIG. 7 is a view in section on the line 7—7 of FIG. 4 illustrating the guidance of the locking body in the handle support.
Figure 8:
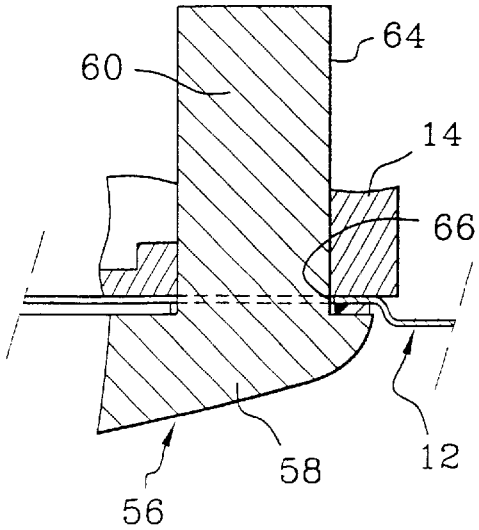
FIG. 8 is a view in section on the broken line 8—8 of FIG. 7.

When the tang 60 of the locking body 56 is engaged in the cavity 62, it can be seen from FIGS. 5 and 6 that it is housed between the two branches 70 of the yoke 68. Once the locking body 56 is in place, the housings 80 formed in its tang 60 are longitudinally facing the lugs 78 of the yoke 68.

According to one aspect of the invention, the yoke 68 is equipped with maneuvering means which allow it to be moved longitudinally back as far as a setback immobilizing position in which the lugs 78 are housed in the housings 80, which transversely immobilizes the locking body 56 with respect to the support 14, and therefore completely immobilizes it.

For this purpose, there is a threaded rod 84 with a longitudinal axis, which is screwed through the base 72 of the yoke. Its rear end, which runs behind the base 72, has an axial hexagon socket 86 which allows it to be manipulated using a tool of the hexagon key type. At its front end, the threaded rod 84 has a bearing cup 88 which is intended to bear axially forward against the rear lateral surface 64 of the tang 60 of the locking body 56. The front end of the rod 84 may also have a recessed socket to make the rod 84 easier to fit on the yoke 68, which is performed before the yoke 68 is introduced into the slideway 74 and therefore before the support 14 is fitted on the opening leaf.

As can be seen in FIGS. 5 and 6, it is thus possible, by turning the threaded rod 84 in the appropriate direction, to make the yoke 68 move back longitudinally with respect to the locking body 56, which is fixed in this direction, until the lugs 78 are brought into the housings 80.

Advantageously, the lugs 78 and the housings 80 have complementing inclined surfaces 90, 92 which, when the yoke is brought into its setback immobilizing position, collaborate in such a way that they cause the locking body 56 to move transversely inward, which allows the bearing face 63 of the body 56 to be clamped against the external face 42 of the outer panel 12. Advantageously, a seal 94 will be placed between the bearing face 63 and the panel 12.

The design of the immobilization of the locking body 56 is particularly advantageous in that it allows easy fitting and removal of the locking body on the support 14, but in cases where the latter is not accessible.

Figure 4:
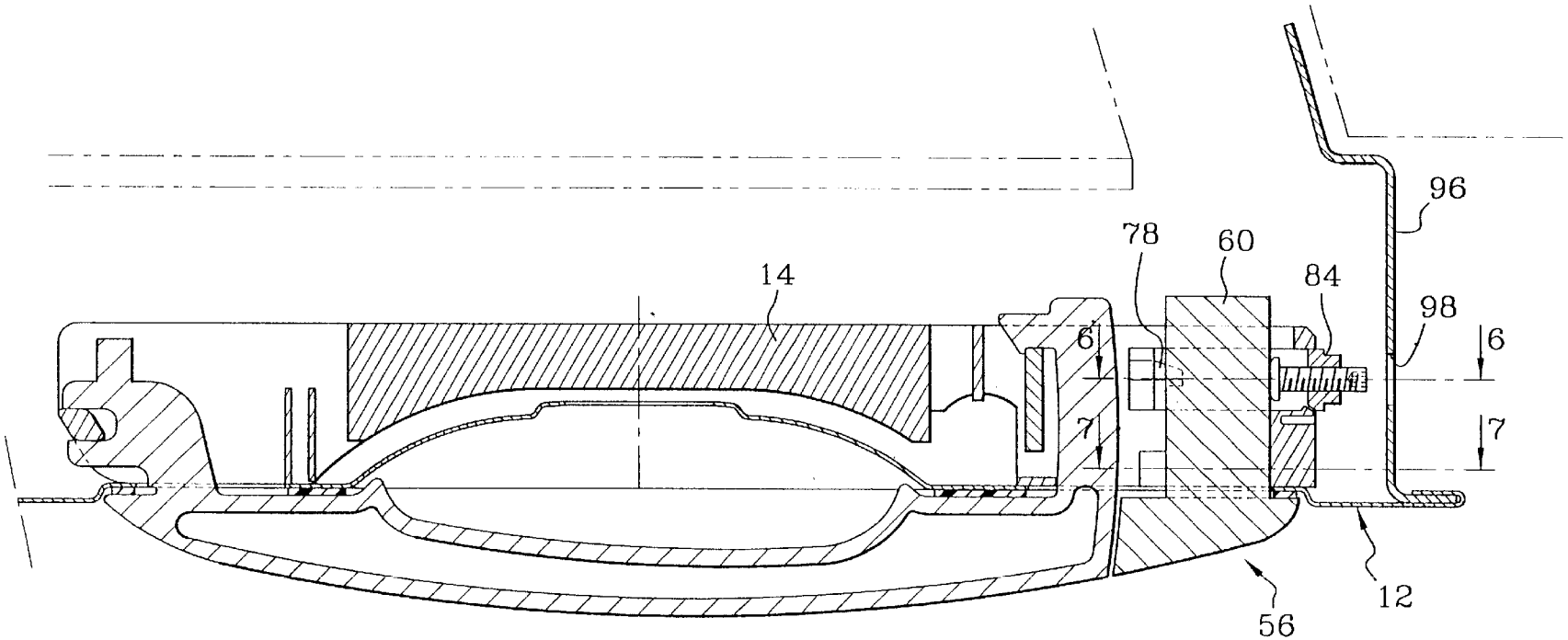

The problem is that the handle support 14 is generally fixed in an internal space of the opening leaf delimited by the outer panel 12, an inner panel parallel to the outer panel, and at least one edge panel 96 which runs transversely to connect the inner panel and the outer panel 12. The inner panel consists, for example, of a door lining. More specifically, as illustrated in FIGS. 2 to 4, the support 14 is generally arranged at a rear end of the opening leaf, near a vertical edge panel 96.

By virtue of the invention, all that is therefore required is for there to be provided, in the edge panel 96, facing the rear end of the threaded rod 84, a hole 98 for the passage of a tool that complements the socket 86. The locking body 56 can thus be immobilized or unlocked without having to access the space inside the panel, simply by engaging the tool through the hole 98 in order to turn the threaded rod 84.

In particular, for repairs which require only the outer parts of the handle to be removed, for example for repainting the bodywork panel, there will be no need to remove the inner panel of the opening leaf, while at the same time avoiding having to arrange the fastening means on the outside of the opening leaf. This removal can be done "blind", without there being any risk of losing the threaded rod 84 either, as this threaded rod, by design, cannot be unscrewed out of the yoke 68 because of the presence of the radial enlargement formed by the bearing cup 88.

It has been seen in the foregoing that the locking body plays a part in attaching the support 14 of the handle 10. However, it could also be envisaged for it also to play a part in holding and/or guiding the grasping lever 24.

Furthermore, the locking body 56 may also form a casing intended to house a latch for deadlocking the opening-leaf lock.

The invention has been described here in the context of the attaching of a locking body to the handle attachment support. However, the teaching of the invention may easily be applied to any external element of a handle which might need to be attached in this way. In particular, the invention may also be applied to the attachment of a fixed grasping bar by means of which the user can move the opening leaf between an open position and a closed position.

What is claimed is:

1. A motor vehicle opening-leaf handle, of the type in which the opening leaf has an internal space delimited by two panels, inner and outer, which are connected by an edge panel, the handle including a handle support which is arranged in the interior space of the opening leaf, an external element of the handle being equipped with an attachment tang which is engaged transversely inward through an orifice formed in the outer panel, to be secured to the handle support and thus attach the external element, the handle further including a member for immobilizing the attachment tang, the immobilizing member being mounted to maneuver between an unlocked position and an immobilizing position by a maneuvering member which can be manipulated through an opening made in the edge panel of the opening leaf, wherein the immobilizing member and manipulating member cooperate to center automatically the attachment tang in the handle support when the immobilizing member is moved to the locked position.

2. The handle according to claim 1, wherein the immobilizing member is mounted so that it can slide in the support in a direction perpendicular to the transverse direction of engagement of the external element, and the immobilizing member includes at least one lug which, in the immobilizing position, is housed in a complementary housing in the tang of the external element to prevent the possibility of the external element being extracted transversely outward.

3. The handle according to claim 2, wherein the lug and the housing collaborate via two complementary surfaces which are inclined with respect to the transverse direction of engagement of the external element and with respect to the direction of sliding of the immobilizing member so that, when the immobilizing member is brought into its immobilizing position, the external element is urged transversely inward by the lug of the immobilizing member.

4. The handle according to claim 1, wherein the tang of the external element is guided in sliding in the transverse direction in the handle support.

5. The handle according to claim 4, wherein the immobilizing member has the shape of a U-shaped yoke with two parallel longitudinal branches connected at their rear end by a base which runs at right angles to the two branches and at right angles to the transverse direction, the yoke is introduced longitudinally from front to rear as far as a forward unlocked position, into a complementary slideway formed at the rear of the support, and the yoke is brought by the maneuvering member longitudinally rearward as far as its immobilizing position in which the lugs formed at the front ends of each branch are engaged in corresponding housings in the tang of the external element, the latter then being housed between the two longitudinal branches of the immobilizing yoke.

6. The handle according to claim 5, wherein the handle support includes means for prepositioning the immobilizing member which, while the handle is being fitted, hold it in its unlocked position.

7. The handle according to claim 5, wherein the maneuvering member comprises a threaded rod of longitudinal axis which is screwed into the base of the yoke, the front end of which bears against a surface which is longitudinally fixed, and the rear end of which exhibits a socket which complements that of a manipulating tool which can be introduced through the opening in the edge panel of the opening leaf.

8. The handle according to claim 7, wherein the threaded rod rests against a lateral surface of the tang of the external element.

9. The handle according to claim 1, wherein the external element forms a locking body which plays a part in attaching the handle to the opening leaf.

10. The handle to according to claim 1, wherein the external element forms a fixed element for grasping by means of which a user may bring the opening leaf from a closed position into an open position.

11. The handle according to claim 1, wherein the external element forms a case intended to house a latch.

12. The handle according to claim 1, wherein the maneuvering member is manipulated toward the attachment tang to contact and immobilize the attachment tang and is manipulated away from the attachment tang to release the attachment tang.

13. The handle according to claim 1, wherein the immobilizing member is mounted to slide in the handle support along an axis substantially transverse to the axis of the attachment tang when engaged to the handle support.

14. The handle according to claim 1, wherein the maneuvering member has a portion thereof which is maneuverable within an internal cavity of the handle support.

15. A handle assembly for a motor vehicle, comprising:

a handle support arranged on an interior side of a panel of the motor vehicle;

external handle element including an attachment tang which is engaged transversely inward from an exterior side of the panel through an opening of the panel to be secured to the handle support;

an immobilizing member to secure and unsecure the attachment tang from the handle support; and a maneuvering member to manipulate the immobilizing member to secure and unsecure the attachment tang from the handle support, the maneuvering member having a portion thereof which is maneuverable within an internal cavity of the handle support.

16. The handle assembly according to claim 15, wherein the handle support is configured to house at least a substantial portion of the immobilizing member therein.

17. The handle assembly according to claim 15, wherein the maneuvering member is to be manipulated through an opening made in an edge panel of the motor vehicle.

18. The handle assembly according to claim 15, wherein the attachment tang is secured inside the handle support.

* * * * *

UNITED STATES PATENT AND TRADEMARK OFFICE

CERTIFICATE OF CORRECTION

PATENT NO. : 6,523,871 B1
DATED : February 25, 2003
INVENTOR(S) : Luc Josserand

It is certified that error appears in the above-identified patent and that said Letters Patent is hereby corrected as shown below:

Title page,
Item [75], Inventor, please change "Turin (IT)" to -- Torino (IT) --.

Signed and Sealed this

Fifteenth Day of July, 2003

JAMES E. ROGAN
*Director of the United States Patent and Trademark Office*